United States Patent [19]

Ruszczyk et al.

[11] Patent Number: 4,646,051

[45] Date of Patent: Feb. 24, 1987

[54] THERMOSTATIC ELECTRIC SWITCH AND THERMAL BIASING ASSEMBLY THEREFOR

[75] Inventors: Vicki V. Ruszczyk; Youn H. Ting, both of Lexington, Ky.

[73] Assignee: Texas Instruments Incorporated, Dallas, Tex.

[21] Appl. No.: 802,489

[22] Filed: Nov. 27, 1985

Related U.S. Application Data

[62] Division of Ser. No. 670,182, Nov. 13, 1984, Pat. No. 4,591,820.

[51] Int. Cl.[4] ..... H01H 61/02; H01H 37/52

[52] U.S. Cl. ..... 337/107; 337/102; 337/354; 337/377

[58] Field of Search ..... 337/102–107, 337/354, 377, 37; 29/622; 338/265, 271–274, 276, 322; 339/30

[56] References Cited

U.S. PATENT DOCUMENTS 4,533,894 8/1985 Bishop et al. ..... 337/107

*Primary Examiner*—Harold Broome

*Attorney, Agent, or Firm*—John A. Haug; James P. McAndrews; Melvin Sharp

[57] ABSTRACT

A housing has a switch chamber in which an electric switch is placed and a recess in which is received a snap acting, thermally responsive disc which actuates and deactuates the switch upon snapping from one configuration to another. A drop in thermal biasing assembly used to modify the operating temperature of the disc has a pair of cylindrical film type resistors electrically connected in parallel circuit relation and physically connected to a pair of connectors. An assembly having resistors of a rating chosen for a particular application is dropped into the recess before the disc is assembled, the connectors sliding into matching bores formed in the housing. The connectors are attached to suitable teminals and the disc is then placed over the thermal biasing assembly to provide a multiple temperature operating thermostat.

14 Claims, 5 Drawing Figures

THERMOSTATIC ELECTRIC SWITCH AND THERMAL BIASING ASSEMBLY THEREFOR

This application is a division of application Ser. No. 670,182, filed 11/13/86 which issued on May 27, 1986 as U.S. Pat. No. 4,591,820.

BACKGROUND OF THE INVENTION

This invention relates generally to thermostatic electric switches and more particularly to means for providing multiple temperature operation.

Thermostatic switches are used for switching of circuits upon the occurrence of preselected temperature conditions. In some applications it is desirable to effect switching upon the occurrence of more than one temperature. While this can be done by providing separate thermostatic switches for each temperature, assuming that there are no space limitations, this involves added expenses due to duplication of parts.

One approach to this problem is shown in U.S. Pat. No. 3,500,277 wherein a thermostatic switch is provided with two bimetal discs each adapted to snap from one dished configuration to an opposite dished configuration at different temperatures controlling separate circuits. A separate motion transfer pin operatively connects each disc to a respective switch. However there are applications where it is desirable to effect actuation of the same circuit at several temperatures which may vary, for example, based on which of several operation cycles is chosen in an application such as a clothes drier with which the switch is used.

It is known for suppliers of appliances using fixed temperature thermostats to mount wire heating units externally to the thermostats in heat conductive relation thereto and use these heaters to modify the effective operating temperature of the thermostat to obtain one or more operating temperatures matched to different cycles provided for this appliance. However locating the heating unit externally of the thermostat is relatively inefficient and results in a system which is slow in responsiveness.

U.S. Pat. No. 3,579,167 shows a thermostatic switch having an internal heater assembly placed adjacent to the bimetal disc and used to separately control the actuation of the disc. Such switches are used for example, for providing "brown-out" protection for compressor motors. The heater assembly includes a ceramic disc with a resistive coating on the face of the substrate which is connected to exterior terminals. While this switch is effective for applications in which several watts of energy are required it is not feasible for lower wattage applications in which it is desired to modify the operating temperature of a disc only a few degrees since so little surface area is available on the ceramic disc for such printed heaters.

In motor protector devices which employ a thermostatic disc adapted to carry motor current, it is a common practice to place one or more wire heaters closely adjacent the disc. These heaters are typically in the 10–20 watt range. For example, as shown in U.S. Pat. No. 2,768,342 one heater is connected in series with the starting winding and a second heater is connected in series with the running winding and both are in series with the thermostatic disc. Normal motor current passing through the heaters and the disc will not be sufficient to raise the temperature of the disc to the point where it snaps to its opposite dished configuration to open the electrical contacts. However an overload in one of the windings will cause increased current flow and heat output from its respective heater which will raise the temperature of the disc until it snaps to open the electrical contacts.

In applications involving thermostatic switches in which the bimetal disc is typically only approximately 0.75 inch in diameter and in which it is desired to thermally bias the disc only slightly, for example in the order of 10 to 15 degrees Farenheit, the use of such heater wire is not feasible. That is, at typical applied voltages of 115 the heater wire would be excessively fine in order to provide sufficient high resistance and would occupy too much space for the thermostatic switches involved which have housings in the order of less than an inch in diameter.

SUMMARY OF THE INVENTIONS

It is therefore an object of the invention to provide an improved thermostatic switch having multiple temperature operation using a single control thermostat. Another object is the provision of such a thermostat which can be easily adapted to provide different operating set points. Yet another object is an improved thermostatic switch which is thermally biased with minimal power input. Other objects and features will in part be apparent and in part pointed out hereinafter.

Briefly, a switch made in accordance to the present invention comprises an assembly having a housing forming a switch chamber therein. A cantilevered movable contact arm mounting a movable contact on its free distal end is adapted to move into and out of engagement with a stationary contact. The housing is formed with a recessed portion at an end thereof and a thermostatic snap acting disc is disposed at the recessed portion. A motion transfer pin is slidably mounted in a bore in the housing extending from the center of the disc to the movable contact arm. A heat conductive cap member is placed over the recessed portion to maintain the disc in place and to conduct ambient heat to the disc. The recessed portion includes an annular shaped groove adjacent the disc seat. A drop in thermal biasing assembly comprising a pair of cylindrical film type resistors of a selected rating have their leads bent approximately 90° with a first lead of each resistor welded to a first elongated connector preferably formed of low thermal conductivity material and a second lead of each resistor welded to a second elongated connector of the same material. The resistors and their leads form a generally rectangular configuration with the connectors depending downwardly. An assembly having the proper wattage rating for a given application is chosen and dropped into place in the thermostat by sliding the connectors into a pair of parallel extending bores formed in the housing until the resistors are disposed in the annular groove adjacent to the disc seat.

In one embodiment the connectors are formed with a transversely extending leg to which the resistor leads are welded and which hold the resistors in their desired location. The lower free distal end of the connectors are received through mating apertures in the body of quick connect terminals and headed over to lock the assembly in place.

In a second embodiment the distal free ends of the leads are bent to extend outwardly parallel to the cylindrical axis of the cylindrical resistor and are received in notches in the connector element. The leads overlap one another with the first lead of one resistor extending over the first lead of the other resistor and the second lead of one resistor extending under the second lead of the other resistor to maintain the selected orientation of the resistors.

BRIEF DESCRIPTION OF THE DRAWINGS

In the accompanying drawings, in which several of various possible embodiments of the inventions are illustrated.

Corresponding reference characters indicate corresponding parts throughout the several views of the drawings.

Figure 1:
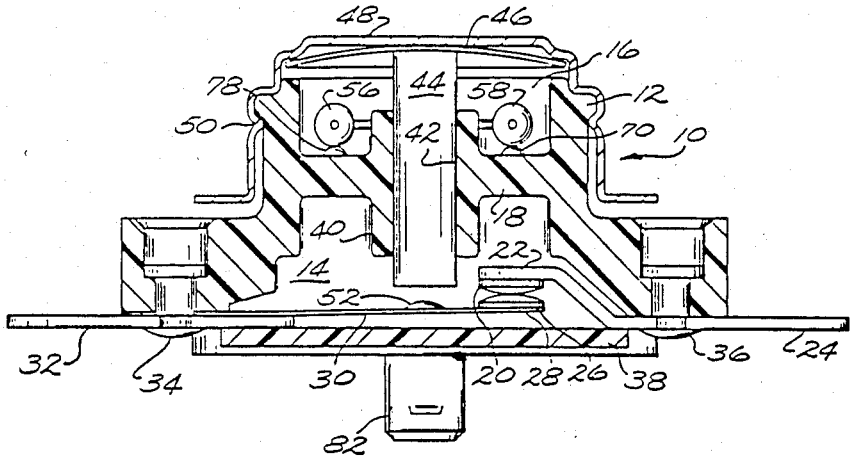
FIG. 1 is a cross sectional elevation view of a thermostatic switch made in accordance with the invention.

Numeral 10 refers generally to a thermostatic switch made in accordance with the invention which comprises a housing 12 of suitable electrically insulative material such as a high temperature phenolic preferably molded to form a switch chamber 14 and a recessed end portion 16 separated by wall 18.

Suitable switch means is disposed in chamber 14 comprising a stationary contact 20 of conventional contact material mounted as by welding on the free distal end 22 of an electrically conductive terminal member 24. Terminal member 24 is bent to extend into the interior of switch chamber 14 to provide space for movement of a movable contact 26. Movable contact 26 is mounted in the distal free end 28 of a flexible, cantilevered, electrically conductive movable contact arm 30. The opposite end of movable contact arm 30 is sandwiched between a terminal 32 and the housing. A rivet 34 is received through suitable apertures in terminal 32 and arm 30 to attach them to housing 12. A similar rivet 36 is used to fix terminal 24 to housing 12. Switch chamber 14 is closed by a plate 38 of electrically insulative material, such as phenolic.

Wall 18 is formed with a centrally located hub 40 formed with a bore 42 extending between switch chamber 14 and recessed end portion 16 and slidably receives therein a motion transfer pin 44.

A thermostatic, snap acting disc 46 is disposed over recessed end portion 16 and is adapted to change from a first dished configuration to a second opposite dished configuration at a first selected actuation temperature and back to the first configuration at a second, lower reset temperature. Disc 46 is maintained in place by a metallic, heat conductive cap 48 which is received over the recessed end of the housing and clamped thereto as indicated at 50. When disc 46 snaps from the downwardly concave configuration shown in FIG. 1 to its opposite downwardly convex configuration, its motion is transferred to arm 30 through pin 44 which extends from the disc to a protrusion 52 formed on arm 30 to move contact 26 out of engagement with stationary contact 20 and open a circuit extending between terminals 32 and 34.

Figure 2:
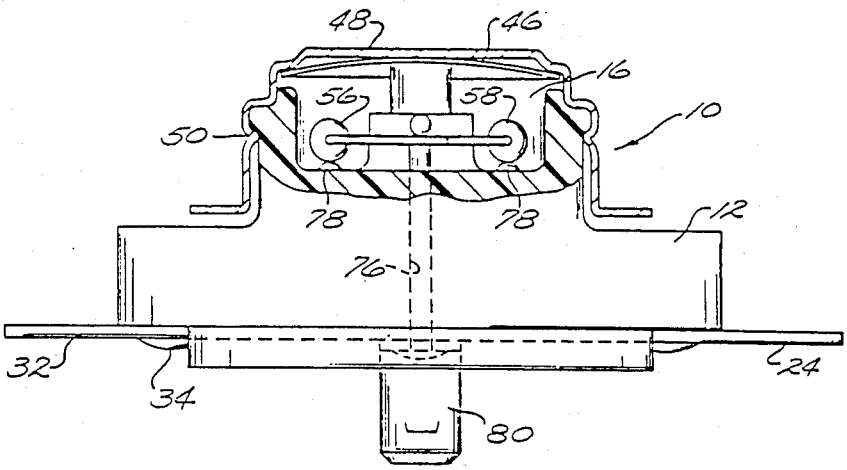
FIG. 2 is an elevation view of the thermostatic switch shown in FIG. 1 broken away to show details of the electrical connectors of the thermal biasing assembly.
Figure 3:
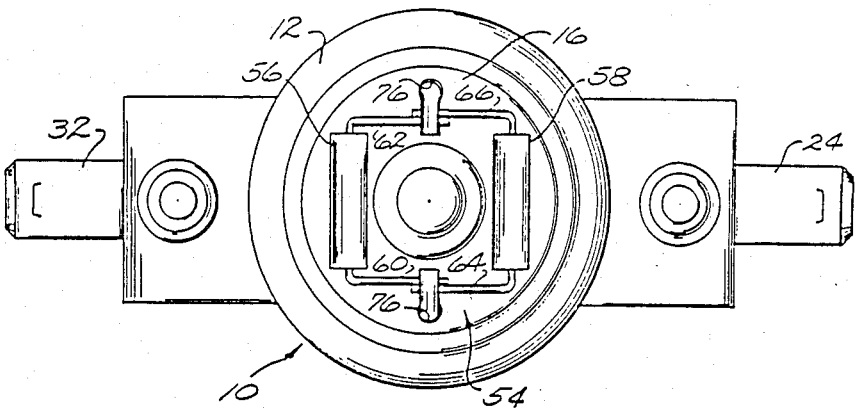
FIG. 3 is a top plan view of the FIG. 1, 2 switch with the heat conductive cap and thermostatic disc removed showing a thermal biasing assembly on place.
Figure 4:
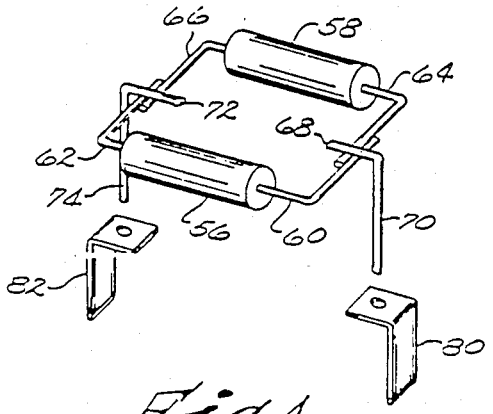
FIG. 4 is a perspective view of the thermal biasing assembly shown in FIGS. 1–3.

In order to modify the temperature at which the disc will snap from one configuration to the other, a thermal biasing assembly 54 is placed in recessed end portion 16. Assembly 54 comprises a pair of cylindrical resistors 56, 58. First and second leads 60, 62 of resistor 56 (see FIGS. 3 and 4) and first and second leads 64, 66 of resistor 58 are bent approximately 90° at a point intermediate their fixed and free ends. The distal free ends of leads 60 and 64 are attached, as by crimping or welding, to the underside of a transversely extending leg 68 projecting from a first end of an elongated connector 70. Similarly, the distal free ends of leads 62, 66 are attached to the underside of a transversely extending leg 72 projecting from a first end of another elongated connector 74. The resistors are connected electrically in parallel and form a generally rectangular configuration and are adapted to fit into the annular space or groove formed in recessed end 16 between hub 40 and the side wall of housing 12. A pair of parallely extending bores 76 (FIGS. 2 and 3) are formed in housing 12 and are adapted to slidingly receive leads 70 and 74. The thermal biasing assembly 54 is dropped into recessed area 16 with leads 70 and 74 received in bores 76 and pushed down into the recess until the resistors contact selected stop surfaces. While the bottom surface of the annular groove can be used as the stop surface, it is preferred to provide stop surfaces 78 which can be conveniently molded into the housing. Alternatively, the vertical position of the thermal biasing assembly can be varied by placing shims of high temperature, electrically insulative material such as Nomex on the bottom surface of recessed area 16. Once assembly 54 is received in its desired location suitable additional terminals, such as "L" shaped quick connects 80 and 82 are placed on bottom of plate 38 with the lower or second end of connectors 70, 74 received in bores formed in the terminals and headed over to lock the thermal biasing assembly in place.

In order to optimize the heat generated in assembly 54, connectors 70, 74 are formed of material which preferably has a relatively low thermal conductivity such as a copper-nickel material or a hollow steel rivet. This is particularly important since the resistor leads are normally of a high heat conductive material such as copper-tin, designed to draw heat away from the resistors which in their normal usage is desirable but is undesirable as used in the present invention.

In order to comply with standard safety codes a minimum distance must be maintained between the thermostatic disc and the top surface of the resistors. Transversely extending legs 68 and 72 serve to ensure that this distance is maintained as well as to maintain the resistors in the position selected to provide desired amount of thermal bias to the disc and to prevent unintended movement of the resistors due to shock, vibration or the like.

A thermostatic switch was made in accordance with the invention using a thermostatic disc, approximately 0.75 inch in diameter and 0.010 inch thick formed of B175 material available from Texas Instruments Incorporated. This material is comprised of a layer of nickel-chrome-iron alloy bonded to a layer of nickel-iron. The disc had a dull or heat absorbing surface with an opening temperature of 155° F. and a closing temperature of 140° F. With a thermal biasing assembly comprising two one half watt metal film cylindrical resistors placed approximately a tenth of an inch from the disc its operating temperature was modified to open at 140° F. and close at 125° F. Additional resistance placed in series with the thermal biasing assembly (but located externally to the switch) then allows other operating temperatures within the 15 degree range between the 155° F. unbiased opening temperature and the 140° F. fully biased opening temperature.

Slightly less thermal biasing can be obtained in the above switch by using a disc or the type described except having a shiny heat deflecting surface which results in a bias of one and a half to two degrees less.

Figure 5:
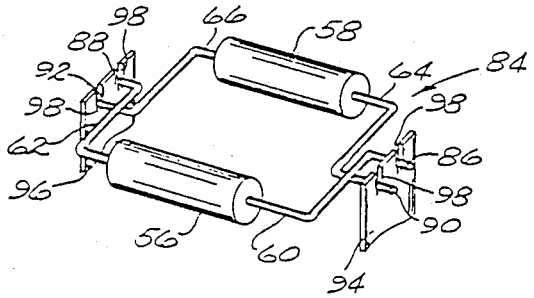
FIG. 5 is a perspective view of an alternate thermal biasing assembly.

As seen in FIG. 5, an alternate thermal bias assembly 84 useful in the invention comprises a pair of resistors 56, 58 in which the distal ends 86, 88, 90 and 92 are bent to extend outwardly generally parallel to the longitudinal axis of the cylindrical resistors. Connectors 94 and 96 are each formed with a pair of upwardly extending slots 98. The distal end portions are respectively received in slots 98 and are welded or otherwise electrically connected to connectors 94, 96. Lead 60 of resistor 56 is placed above lead 64 of resistor 58 while lead 66 of resistor 58 is placed on top of lead 62 of resistor 56. By reversing the overlap arrangement on the opposite ends of the resistors a more stable assembly is achieved thereby preventing undersirable dislodgement of the resistors from their selected seat locations.

In view of the above, it will be seen that the several objects of the invention are achieved and other advantageous results obtained. In carrying out the invention either metal layer or carbon layer cylindrical resistors can be employed.

As various changes could be made in the above construction and methods without departing from the scope of the invention, it is intended that all matter included in the above description or shown in the accompanying drawings be interpreted as illustrative not in a limiting sense.

We claim:

1. In a thermostatic electric switch having a housing formed with a switch chamber, stationary and movable contact means disposed in the chamber, the movable contact means adapted to move into and out of engagement with the stationary contact means, terminal means electrically connected to the stationary contact means and the movable contact means to form a circuit, the housing having a recessed end portion, a motion transfer member movably received in an aperture in the housing, the member extending from the movable contact means into the recessed end portion, a thermostatic member disposed at the recessed end portion, the member movable on the occurrence of selected thermal conditions between a first configuration and a second configuration, the motion of the member being transferred to the movable contact means through the motion transfer member, a metallic cap member received over the recessed end portion, the improvement comprising a thermal biasing assembly received in the recessed end portion of the housing to modify the effective calibration of the member, a stop surface formed in the recessed end portion of the housing, the assembly comprising a pair of generally cylindrical resistors, the resistors having first and second leads extending from opposite ends of the resistors, a pair of connector elements having an end, the distal end of a lead of each resistor electrically connected to the end of one connector element and the distal end of the other lead of each resistor electrically connected to the end of the other connector element, the resistors engaging the stop surfce to locate the thermal biasing assembly in a selected heat transfer position relative to the member whereby the effective calibration of the thermostatic member can be effectively modified by choosing a particular value of resistance for the pair of resistors.

2. In a thermostatic switch according to claim 1 further including additional terminal means which comprise a pair of quick connect terminal members, each having a body portion, an aperture formed in each body portion and a second end of the connector elements received through the aperture and headed over to lock the thermal biasing assembly in place.

3. In a thermostatic switch according to claim 1 wherein the connector elements are generally round in cross section.

4. In a thermostatic switch according to claim 1 wherein the connector elements are generally rectangular in cross section.

5. In a thermostatic switch according to claim 1 wherein the disc is generally circular having a diameter approximately $\frac{3}{4}$ of an inch and the resistors are each $\frac{1}{2}$ watt whereby thermal biasing of the disc of approximately 15° F. is obtained.

6. In a thermostatic switch according to claim 1 wherein the elongated connector elements are formed of material having relatively poor thermal conductivity.

7. In a thermostatic switch according to claim 6 wherein the elongated connector elements are formed of copper-nickel material.

8. In a thermostatic switch according to claim 22 wherein the elongated connector elements are formed of steel.

9. In a thermostatic electric switch having a housing formed with a switch chamber, stationary and movable contact means disposed in the chamber, the movable contact means adapted to move into and out of engagement with the stationary contact means, terminal means electrically connected to the stationary contact means and the movable contact means to form a circuit, the housing having a recessed end portion, a motion transfer member movably received in an aperture in the housing, the member extending from the movable contact means into the recessed end portion, a thermostatic member disposed at the recessed end portion, the member movable on the occurrence of selected thermal conditions between a first configuration and a second configuration, the motion of the member being transferred to the movable contact means through the motion transfer member, a metallic cap member received over the recessed end portion, the improvement comprising a thermal biasing assembly received in the recessed end portion of the housing to modify the effective calibration of the member, the assembly comprising a pair of generally cylindrical resistors, the resistors having first and second leads formed of material having a relatively high thermal conductivity extending from opposite ends of the resistors, means to electrically energize the resistors including a pair of connector elements having an end, the distal end of a lead of each resistor electrically connected to the end of one connector element and the distal end of the other lead of each resistor element electrically connected to the end of the other connector element, the connector elements being formed of material having poor thermal conductivity relative to the resistor leads to thereby limit heat loss from the resistors.

10. In a thermostatic switch according to claim 9 wherein the elongated connector elements are formed of copper-nickel material.

11. In a thermostatic switch according to claim 9 wherein the elongated connector elements are formed of steel.

12. In a thermostatic electric switch having a housing formed with a switch chamber, stationary and movable contact means disposed in the chamber, the movable contact means mounted on a movable contact arm and adapted to move into and out of engagement with the stationary contact means, terminal means connected to the stationary contact means and the movable contact means to form a circuit, the housing having a recessed end portion, a motion transfer member movably received in an aperture in the housing, the member extending from the movable contact arm into the recessed end portion, a thermostatic disc disposed at the recessed end portion, the disc movable on the occurrence of selected thermal conditions between a first dished configuration and a second oppositely dished configuration, the motion of the disc being transferred to the movable contact arm through the motion transfer member, a metallic cap member received over the recessed end portion to maintain the disc in its selected location, the improvement comprising a thermal biasing assembly to modify the effective calibration of the disc, the assembly comprising a pair of generally cylindrical resistors, the resistors having first and second leads extending from opposite ends of the resistors, each of the leads bent at a point intermediate its ends, a pair of connector elements having an end, the distal end of a lead of each resistor electrical connected to the end of one connector element and the distal end of the other lead of each resistor element electrically connected to the end of the other connector element, additional terminal means, the connector elements having a second end electrically connected to the additional terminal means, the connector elements being formed of material having relatively poor thermal conductivity.

13. In a thermostatic electric switch according to claim 12 wherein the elongated connector elements are formed of copper-nickel material.

14. In a thermostatic electric switch according to claim 12 wherein the elongated connector elements are formed of steel.

* * * * *